US007817128B2

(12) United States Patent
Suguro

(10) Patent No.: US 7,817,128 B2
(45) Date of Patent: Oct. 19, 2010

(54) LIQUID CRYSTAL DISPLAY DEVICE AND DRIVING CIRCUIT FOR LIQUID CRYSTAL PANEL WITH A MEMORY EFFECT

(75) Inventor: Akira Suguro, Fujimi (JP)

(73) Assignee: Citizen Holdings Co., Ltd., Tokyo (JP)

( * ) Notice: Subject to any disclaimer, the term of this patent is extended or adjusted under 35 U.S.C. 154(b) by 917 days.

(21) Appl. No.: 11/153,895

(22) Filed: Jun. 16, 2005

(65) Prior Publication Data

US 2006/0012591 A1 Jan. 19, 2006

(30) Foreign Application Priority Data

Jun. 17, 2004 (JP) ..... 2004-179041
May 30, 2005 (JP) ..... 2005-158130

(51) Int. Cl.
*G09G 3/36* (2006.01)

(52) U.S. Cl. ..... 345/97

(58) Field of Classification Search ..... 345/97, 345/204

See application file for complete search history.

(56) References Cited

U.S. PATENT DOCUMENTS 5,400,048 A * 3/1995 Shimada et al. ..... 345/97
5,646,755 A * 7/1997 Okada et al. ..... 345/97
5,777,593 A * 7/1998 Kondoh ..... 345/97
5,838,293 A * 11/1998 Kondoh ..... 345/97
6,163,360 A * 12/2000 Tanaka et al. ..... 349/172
6,509,887 B1 * 1/2003 Kondoh et al. ..... 345/87
6,567,065 B1 * 5/2003 Kondoh et al. ..... 345/97
2002/0191137 A1 * 12/2002 Kondoh ..... 349/123
2003/0063060 A1 * 4/2003 Yoo et al. ..... 345/97

FOREIGN PATENT DOCUMENTS

JP 63-212921 9/1988
JP 2001-42812 2/2001

* cited by examiner

*Primary Examiner*—Amr Awad
*Assistant Examiner*—Waseem Moorad
(74) *Attorney, Agent, or Firm*—Westerman, Hattori, Daniels & Adrian, LLP

(57) ABSTRACT

A driving circuit applies, to scanning electrodes of a liquid crystal panel with a memory effect, a scanning voltage composed of zero and a positive or negative unipolar voltage waveform, and also applies, to signal electrodes, a signal voltage composed of zero and a unipolar voltage waveform having the same polarity as that of the scanning voltage. Further, image data is displayed at a pixel of the liquid crystal panel with a memory effect during a plurality of scanning periods, such that the polarities of the voltages applied between the scanning electrode and the signal electrode at a portion forming a pixel of the liquid crystal panel with a memory effect during a first scanning period and during a subsequent period of the plurality of periods are inverted.

25 Claims, 10 Drawing Sheets

LIQUID CRYSTAL DISPLAY DEVICE AND DRIVING CIRCUIT FOR LIQUID CRYSTAL PANEL WITH A MEMORY EFFECT

BACKGROUND OF THE INVENTION

1. Field of the Invention

The present invention relates to a liquid crystal display device and a driving circuit for a liquid crystal panel with a memory effect, and particularly to a liquid crystal display device and a driving circuit for its liquid crystal panel with a memory effect in which a memory effect presented by two stable states of a liquid crystal having a memory effect is utilized to enable operation at a low voltage and reduce the power consumption.

2. Description of the Related Art

As a display device of a personal digital assistant in which the display screen is not often switched, such as used in an electronic book or electronic newspaper which has recently received much attention, a liquid crystal panel with a memory effect using a liquid crystal having a memory effect has drawn attention. Having a memory effect means that a display state can be maintained even during application of no voltage. Using the characteristics enables reduction in the power consumption of the liquid crystal display device. A ferroelectric liquid crystal, a cholesteric liquid crystal, and so on are known as materials of the liquid crystal for use in the liquid crystal panel with a memory effect.

Such a liquid crystal panel with a memory effect has a liquid crystal having a memory effect having at least two stable sates between a pair of substrates (glass substrates) which have scanning electrodes and signal electrodes on their opposed surfaces, respectively.

FIG. 7 is a plane view of portions of the scanning electrodes and signal electrodes as seen from a direction perpendicular to the substrate surface of the liquid crystal panel, in which TP1 to TP4 are scanning electrodes and SG1 to SG4 are signal electrodes. A liquid crystal having a memory effect exists between the scanning electrodes and the signal electrodes, and portions where the scanning electrodes TP1 to TP4 are opposed to the signal electrodes SG1 to SG4 with the liquid crystal having a memory effect intervening therebetween (portions where the scanning electrodes TP1 to TP4 overlap the signal electrodes SG1 to SG4 in FIG. 7) form pixels Pix, respectively.

Electro-optic effects of the ferroelectric liquid crystal used as the liquid crystal having a memory effect will be described now. FIG. 8 and FIG. 9 are explanatory views each showing the relation between a molecular long axis direction of the ferroelectric liquid crystal and an electric field. These drawings, which schematically show the liquid crystal molecule when a liquid crystal panel 1 is seen from a viewer side, are used to describe an average molecular long axis direction of the ferroelectric liquid crystal.

For example, when an electric field E occurs from the front side to the rear side in a direction perpendicular to the paper surface of the drawing as shown in FIG. 8, a liquid crystal molecule LCM is in a first ferroelectric state. An average molecular long axis direction M in that state is stable inclined counterclockwise by an angle θ1 with respect to an alignment axis OA of an alignment film. On the other hand, when the electric field E occurs from the rear side to the front side of the paper surface of the drawing as shown in FIG. 9, the liquid crystal molecule LCM is in a second ferroelectric state. The average molecular long axis direction M in that state is stable inclined clockwise by an angle θ2 with respect to the alignment axis OA.

In other words, the liquid crystal molecule LCM transfers on the side surface of a cone shape drawn with the molecular long axis direction M as a moving straight line. Further, the sum of the angle θ1 and the angle θ2 (θ1+θ2) is an angle between the average molecular long axis direction of the liquid crystal in the first ferroelectric state and the average molecular long axis direction of the liquid crystal in the second ferroelectric state, that is, a central angle of the cone (that is a cone angle) θ.

FIG. 10 is an explanatory view showing the relation between the molecular long axis direction of the ferroelectric liquid crystal and absorption axes of a pair of polarizing plates disposed outside a pair of substrates having the liquid crystal therebetween. As shown in this drawing, in the case using the ferroelectric liquid crystal, a first polarizing plate and a second polarizing plate are typically arranged such that a polarization axis P1 of the first polarizing plate and a polarization axis P2 of the second polarizing plate form an angle of almost 90° C. (to be perpendicular). Further, one of the polarization axes is aligned with the molecular long axis direction M when the ferroelectric liquid crystal is in the first or second ferroelectric state (in the example shown in FIG. 10, the molecular long axis direction M being aligned with the polarization axis P1).

As described above, in the ferroelectric state in which the molecular long axis direction M is aligned with the polarization axis, the transmittance decreases, thereby enabling a black image. When the electric field E is inversely directed, the liquid crystal molecule LCM moves with the alignment axis OA as a symmetrical axis to increase in transmittance, thereby enabling a white image.

The polarizing plate used here is an absorption-type polarizing plate which absorbs linearly polarized light whose polarization direction is parallel to its absorption axis and transmits linearly polarized light whose polarization direction is parallel to its polarization axis (transmission axis) perpendicular to the absorption axis.

FIG. 11 is a characteristic chart showing the relation between the voltage applied to a liquid crystal panel in which the ferroelectric liquid crystal and the pair of polarizing plates are arranged as described above, the transmittance, and two stable states of the ferroelectric liquid crystal.

The ferroelectric liquid crystal has two stable states, which are switched by applying a positive or negative voltage exceeding a threshold voltage Vt or −Vt, so that the first ferroelectric state (ON state) or the second ferroelectric state (OFF state) can be selected depending on the polarity of the applied voltage. More specifically, during the initial (application of no voltage) period, the ferroelectric liquid crystal exits stabile in the first or the second ferroelectric state. For example, when the applied voltage exceeds the threshold voltage Vt on the positive side while the ferroelectric liquid crystal is stabile in the second ferroelectric state (the black image state with a low transmittance), the ferroelectric liquid crystal is brought into the first ferroelectric state (the white image state with a high transmittance). Even if the applied voltage is gradually decreased from that state, the first ferroelectric state is maintained.

However, when the applied voltage exceeds the threshold voltage −Vt on the negative side, the liquid crystal is brought into the second ferroelectric state (the black image state with a low transmittance). Even if the applied voltage is gradually increased from that state, the second ferroelectric state is maintained. As is clear from the characteristic chart, the liquid crystal panel using the ferroelectric liquid crystal can maintain the transmittance, that is, the display state even during application of no voltage, that is, while the power consumption is zero. The characteristics mean having a memory effect.

Incidentally, the liquid crystal panel in which the pixels Pix are formed in a matrix form as shown in FIG. 7 typically performs display in a time division driving method. More specifically, a scanning voltage is applied from a scanning electrode driving circuit (not shown) sequentially to the scanning electrodes TP1 to TP4 line by line, for example, to TP1, TP2, and so on, in synchronization with which, a signal voltage is applied from a signal electrode driving circuit (not shown) to signal electrodes SG1 to SG4 in a parallel manner. Note that the signal voltage is outputted in a waveform corresponding to image data to be displayed at each of the pixels Pix.

Further, a pair of polarizing plates (not shown) are arranged outside the liquid crystal panel such that their absorption axes are in a crossed-Nicols state so as to create the white image in the above-described ON state and the black image in the OFF state.

Next, a conventional driving method for bringing the pixels in such a ferroelectric liquid crystal panel into the white image or the black image will be described using FIG. 12. FIG. 12 shows a driving voltage waveform and a transmittance curve of a typical ferroelectric liquid crystal panel when a pixel Pix (1, 1) at the first row and first column in FIG. 7 is brought into the white image ON (W) and the black image OFF (B). To bring the pixel Pix (1, 1) at the first row and first column shown in FIG. 7 into the white image, during a scanning period (1 frame=F1) for displaying one screen, a reset period RS is set at the first portion, and a selection period SE for determining the display state and a non-selection period NSE for maintaining the display state are set thereafter.

During the reset period RS, bipolar pulses of voltages ±VRT are outputted as the scanning voltage to the scanning electrode TP1. Further, bipolar pulses of voltages ±VRS are outputted as the signal voltage to all of the signal electrodes SG1 to SG4. Thereby, a voltage of a composite voltage waveform made by combining the signal voltage waveform and the scanning voltage waveform is applied to the pixel Pix (1, 1) during the reset period RS, so that reset pulses of the voltages (VRT+VRS) and −(VRT+VRS) are applied as the composite voltage TS (1, 1). As for the transmittance, as shown at TV (1, 1), the pixel Pix (1, 1) is brought into the first ferroelectric state, that is, the white image with a high transmittance during the first half of the reset period RS because the positive voltage exceeding the threshold voltage Vt on the positive side described with FIG. 11 is applied, whereas the pixel Pix (1, 1) is brought into the second ferroelectric state, that is, the black image with a low transmittance during the second half of the reset period RS because the negative voltage exceeding the threshold voltage −Vt on the negative side.

Subsequently, during the selection period SE, zero and bipolar pulses at −VS and +VS are applied as the scanning voltage to the scanning electrode TP1, and zero and bipolar pulses at +VD and −VD being data voltages are applied to the signal electrode SG1. Thereby, the voltages of voltages zero, −(VS+VD), and (VS+VD) as selection pulses are applied between the scanning electrode TP1 and the signal electrode SG1 as the composite voltage TS (1, 1). Since the last voltage (VS+VD) exceeds the threshold voltage Vt on the positive side described with FIG. 11, the second ferroelectric state is changed to the first ferroelectric state and the transmittance shown at TV (1, 1) increases to thereby select the white image.

During the non-selection period NSE, the voltage of the scanning voltage applied to the scanning electrode TP1 is zero, and the signal voltage in a pulse waveform composed of the voltages zero and +VD and −VD being the data voltages is applied to the signal electrode SG1. The pulse shown by a square in the drawing is a pulse composed of the voltages zero, +VD, and −VD, and is composed of three pulses here. These may be, for example, three pulses of the voltages zero, +VRS, and −VRS similar to the reset voltage, or may be applied in another order.

During the non-selection period NSE, the signal voltage is reflected, as it is, on the composite voltage TS (1, 1), so that the voltages at the voltages zero, −VD, and +VD as holding pulses are applied between the scanning electrode TP1 and the signal electrode SG1. Since the absolute value of any of the voltages is smaller than the threshold voltage Vt or −Vt, the ferroelectric state determined during the selection period SE, that is, the transmittance is maintained, maintaining the white image.

As described above, in the conventional driving method, the driving voltage is composed of the bipolar reset pulses, the bipolar selection pulses and holding pulses, and requires nine level values (zero, ±VS, ±VD, ±VRS, and ±VRT). Further, because of bipolar pulses, the peak-peak value (±(VRT +VRS) in FIG. 12) needs to be twice the voltage to which the liquid crystal reacts.

As described above, pulse voltages at many values have conventionally been required to drive the liquid crystal panel with a memory effect, leading to complicated configurations of the scanning electrode driving circuit for outputting the scanning voltage and the signal electrode driving circuit for outputting the signal voltage (respective driver ICs), and increased cost.

Hence, to decrease the load on the scanning electrode driving circuit and the signal electrode driving circuit (driver ICs), a method is proposed in which respective independent voltage converting means are provided separately from the aforementioned driving circuits so as to vary the driving voltages to be applied to the scanning electrodes and the signal electrodes of the liquid crystal panel respectively, such as found in JP 2001-42812A. The liquid crystal element with a memory effect disclosed therein uses a cholesteric liquid crystal or a chiral nematic liquid crystal as the liquid crystal material and employs a configuration in which three display layers are stacked in the thickness direction.

Further, as found, for example, in JP 63-212921A, there also is a proposed liquid crystal display device in which the kinds of voltage level values of the driving voltages outputted by the scanning electrode driving circuit and the signal electrode driving circuit (driver ICs) are reduced, and both the scanning voltage waveform and the signal (data) voltage waveform are made unipolar.

As described above, time division drive the matrix-type liquid crystal panel which uses the ferroelectric liquid crystal having an operation mode with a memory effect and includes the scanning electrodes and the signal electrodes, the driving voltage requires many voltage level values because the scanning voltage to be applied to the scanning electrode is composed of the bipolar reset pulses and selection pulses and the signal voltage to be applied to the scanning electrode is composed of the bipolar reset pulses, selection pulses, and holding pulses in one scanning period (1 frame). Further, because of bipolar pulses, the peak-peak value need to be twice the voltage to which the liquid crystal reacts, and a driver IC with a high withstand voltage is required especially for driving the scanning electrodes, bringing about a problem of the IC being increased in chip size and price.

In the liquid crystal display device described in the above-described JP 2001-42812A, the scanning voltage and the signal (data) voltage are also formed by combining positive and negative voltages at many different level values. To this end, respective independent voltage converting means are provided separately from the driving circuits (driver ICs) and a high withstand voltage switch is used for switching the driving voltage, resulting in increased cost.

In the liquid crystal display device described in the above-described JP 63-212921A, both the driving voltage waveforms outputted by the scanning electrode driving circuit and the signal electrode driving circuit (driver ICs) are unipolar, and the kinds of required voltage level values are also reduced. However, voltage levels at five values, that is, 0, V, ½V, ¾V, and ¼V are still required, and both of the waveforms of the scanning voltage and the signal voltage are complicated, resulting in increased cost.

SUMMARY OF THE INVENTION

The present invention has been developed in consideration of the above background, and its object is, in a liquid crystal display device composed of a liquid crystal panel with a memory effect and its driving circuit, to minimize the level values of the driving voltages outputted by a scanning electrode driving circuit and a signal electrode driving circuit (driver ICs) being the driving circuit, to eliminate use of a high withstand voltage element, and to enable the scanning electrode driving circuit and the signal electrode driving circuit to have the same configuration, thereby reducing cost.

The invention is a liquid crystal display device including a liquid crystal panel with a memory effect including a liquid crystal having a memory effect having at least two stable states sandwiched between a pair of substrates providing scanning electrodes and signal electrodes on opposed surfaces respectively, portions thereof where the scanning electrodes are opposed to the signal electrodes with the liquid crystal having a memory effect intervening therebetween forming pixels; and a driving circuit for driving the liquid crystal panel with a memory effect to cause the pixels to display image data, characterized in that it is configured as follows to attain the above-described object.

The driving circuit applies, to the scanning electrode of the liquid crystal panel with a memory effect, a scanning voltage of a voltage waveform composed of a voltage zero and a positive or negative unipolar voltage, and also, to the signal electrode, a signal voltage of a voltage waveform composed of a voltage zero and a unipolar voltage having the same polarity as the polarity of the scanning voltage.

Further, the image data displayed at the pixel is displayed during a plurality of scanning periods, the polarities of the voltages applied between the scanning electrode and the signal electrode forming the pixel during a first scanning period and during a subsequent scanning period of the plurality of scanning periods are inverted.

It is preferable that a reference potential of the scanning voltage during the first scanning period outputted by the driving circuit is different from a reference potential of the scanning voltage during the subsequent scanning period.

Further, it is also preferable that a reference potential of the signal voltage during the first scanning period outputted by the driving circuit is different from a reference potential of the signal voltage during the subsequent scanning period.

Further, it is preferable that a composite waveform of the voltage waveform of the scanning voltage and the voltage waveform of the signal voltage outputted by the driving circuit is a waveform of a composite voltage applied between the scanning electrode and signal electrode at the portion forming the pixel, and that one scanning period of the plurality of scanning periods includes a reset period for bringing the liquid crystal having a memory effect at the pixel into a first stable state and a selection period for bringing the liquid crystal having a memory effect into the first stable state or a second stable state.

Further, the waveform of the composite voltage has a reset pulse during the reset period and has a selection pulse during the selection period. It is preferable that the reset pulse is composed of the voltage waveform of the signal voltage with the scanning voltage being zero, and that the selection pulse is composed of the voltage waveform of the scanning voltage with the signal voltage being zero.

It is possible that the reset pulse during the reset period and the selection pulse during the selection period are equal in pulse width and pulse voltage.

It is possible that each of the voltage waveform of the scanning voltage and the voltage waveform of the signal voltage outputted by the driving circuit is composed of three values which are a voltage zero, a first positive or negative voltage (VD) smaller in absolute value than threshold voltages at which the stable state of the liquid crystal having a memory effect changes, and a second voltage (VS) having the same polarity as the polarity of the first voltage and being larger in absolute value than the said threshold voltages.

Further, it is also possible that the reset pulse is composed of a first positive or negative voltage (VD) smaller in absolute value than threshold voltages at which the stable state of the liquid crystal having a memory effect changes, as the scanning voltage, and a third voltage (VD+VS) made by adding the first voltage and a second voltage (VS) having the same polarity as the polarity of the first voltage and being larger in absolute value than said threshold voltages, as the signal voltage, and that the selection pulse is composed of the second voltage (VS) as the scanning voltage, and zero or the first voltage (VD) as the signal voltage.

It is preferable that the reset pulse and the selection pulse are applied during the first scanning period of the plurality of scanning periods.

It is possible that each of the voltage waveform of the scanning voltage and the voltage waveform of the signal voltage outputted by the driving circuit is composed of four values which are the voltage zero, the first voltage (VD), the second voltage (VS), and the third voltage (VD+VS).

It is also preferable that a reference potential of the scanning voltage during the first scanning period is different from a reference potential of the scanning voltage during the subsequent scanning period, and each of the reference potentials is the voltage zero or the first voltage (VD).

It is preferable that the liquid crystal having a memory effect in the liquid crystal panel with a memory effect is a ferroelectric liquid crystal.

The invention also provides a driving circuit for the above-described liquid crystal panel with a memory effect to attain the above-described object.

The driving circuit includes a scanning electrode driving circuit for applying a scanning voltage to the scanning electrodes, and a signal electrode driving circuit for applying a signal voltage to the signal electrodes, the scanning electrode driving circuit outputting a scanning voltage of a voltage waveform composed of a voltage zero and a unipolar positive or negative voltage, and the signal electrode driving circuit outputting a signal voltage of a voltage waveform composed of a voltage zero and a unipolar voltage having the same polarity as the polarity of the scanning voltage.

Further, a composite voltage of the scanning voltage and the signal voltage outputted during the plurality of scanning periods is applied between the scanning electrode and the signal electrode at the portion forming the pixel to cause the pixel to display image data, and the polarities of the composite voltages applied between the scanning electrode and the signal electrode at the portion forming the pixel during a first scanning period and during a subsequent period of the plurality of scanning periods are inverted.

It is possible that a reference potential of the scanning voltage outputted during the first scanning period by the scanning electrode driving circuit is different from a reference potential of the scanning voltage outputted during the subsequent scanning period.

Further, it is also preferable that a reference potential of the signal voltage during the first scanning period outputted by the signal electrode driving circuit is different from a reference potential of the signal voltage during the subsequent scanning period.

A composite waveform of the voltage waveform of the scanning voltage and the voltage waveform of the signal voltage is a waveform of a composite voltage applied between the scanning electrode and signal electrode at the portion forming the pixel, wherein one scanning period of the plurality of scanning periods includes a reset period for bringing the liquid crystal having a memory effect at the pixel into a first stable state and a selection period for bringing the liquid crystal having a memory effect into the first stable state or a second stable state.

It is preferable that, during the reset period, the scanning electrode driving circuit brings the scanning voltage to a voltage zero, and the signal electrode driving circuit brings the signal voltage to a voltage (VS) larger in absolute value than the threshold voltages at which the stable state of the liquid crystal having a memory effect changes.

Further, it is preferable that during the selection period, the scanning electrode driving circuit brings the scanning voltage to a voltage (VS) larger in absolute value than the threshold voltages at which the stable state of the liquid crystal having a memory effect changes, and the signal electrode driving circuit brings the signal voltage to a voltage zero.

It is possible that the voltage of the signal voltage outputted by the signal electrode driving circuit during the reset period is equal to the voltage of the scanning voltage outputted by the scanning electrode driving circuit during the selection period.

It is preferable that the voltages outputted by each of the scanning electrode driving circuit and the signal electrode driving circuit are three values which are a voltage zero, a voltage (VD) smaller in absolute value than the threshold voltages at which the stable state of the liquid crystal having a memory effect changes, and the voltage (VS) larger in absolute value than the threshold voltages at which the stable state of the liquid crystal having a memory effect changes.

It is also preferable that a composite waveform of the voltage waveform of the scanning voltage and the voltage waveform of the signal voltage is a waveform of a composite voltage applied between the scanning electrode and signal electrode at the portion forming the pixel, that one scanning period of the plurality of scanning periods includes a reset period for bringing the liquid crystal having a memory effect at the pixel into a first stable state and a selection period for bringing the liquid crystal having a memory effect into the first stable state or a second stable state, that during the reset period, the scanning electrode driving circuit brings the scanning voltage to a first voltage (VD) smaller in absolute value than threshold voltages at which the stable state of the liquid crystal having a memory effect changes, and the signal electrode driving circuit brings the signal voltage to a third voltage (VD+VS) being a sum of a second voltage (VS) larger in absolute value than the threshold voltages at which the stable state of the liquid crystal having a memory effect changes and the first voltage (VD), and that during the selection period, the scanning electrode driving circuit brings the scanning voltage to the second voltage (VS), and the signal electrode driving circuit brings the signal voltage to a voltage zero or the first voltage (VD).

It is preferable that the scanning electrode driving circuit and the signal electrode driving circuit output a voltage of the third voltage (VD+VS) during the first scanning period of the plurality of scanning periods.

It is possible that the voltages outputted by the scanning electrode driving circuit and the signal electrode driving circuit are four values which are the voltage zero, the first voltage (VD), the second voltage (VS), and the third voltage (VD+VS).

It is preferable that a reference potential during the first scanning period of the voltage outputted by each of the scanning electrode driving circuit and the signal electrode driving circuit is different from a reference potential during the subsequent scanning period, and each of the reference potentials is the voltage zero or the first voltage (VD).

It is preferable that the scanning electrode driving circuit and the signal electrode driving circuit have the same circuit configuration and are compatible with each other.

According to the invention, each of the voltage waveforms of the scanning voltage and the signal voltage outputted by the driving circuit to drive the liquid crystal panel with a memory effect can be unipolar, that is, positive or negative; the level values of the voltages forming each of the voltage waveforms, that is, the kinds of the voltages can be three values or four values even including both the aforementioned voltages; and each of the voltage waveforms can be made simple.

Accordingly, the scanning electrode driving circuit and the signal electrode driving circuit (driver ICs) can be reduced in size and manufactured at low cost. This allows a liquid crystal display device provided with the liquid crystal panel with a memory effect to be provided at low cost. In addition, the scanning electrode driving circuit and the signal electrode driving circuit can be configured the same to have compatibility with each other so that one can be used for both of them, further reducing the cost.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, a liquid crystal display device according to the invention and a driving circuit for its liquid crystal panel with a memory effect will be described in detail with reference to the accompanying drawings.

First Embodiment

A first embodiment of the invention will be described using FIG. 1 to FIG. 4, and FIG. 7 and FIG. 11 which have been described above.

Figure 1:
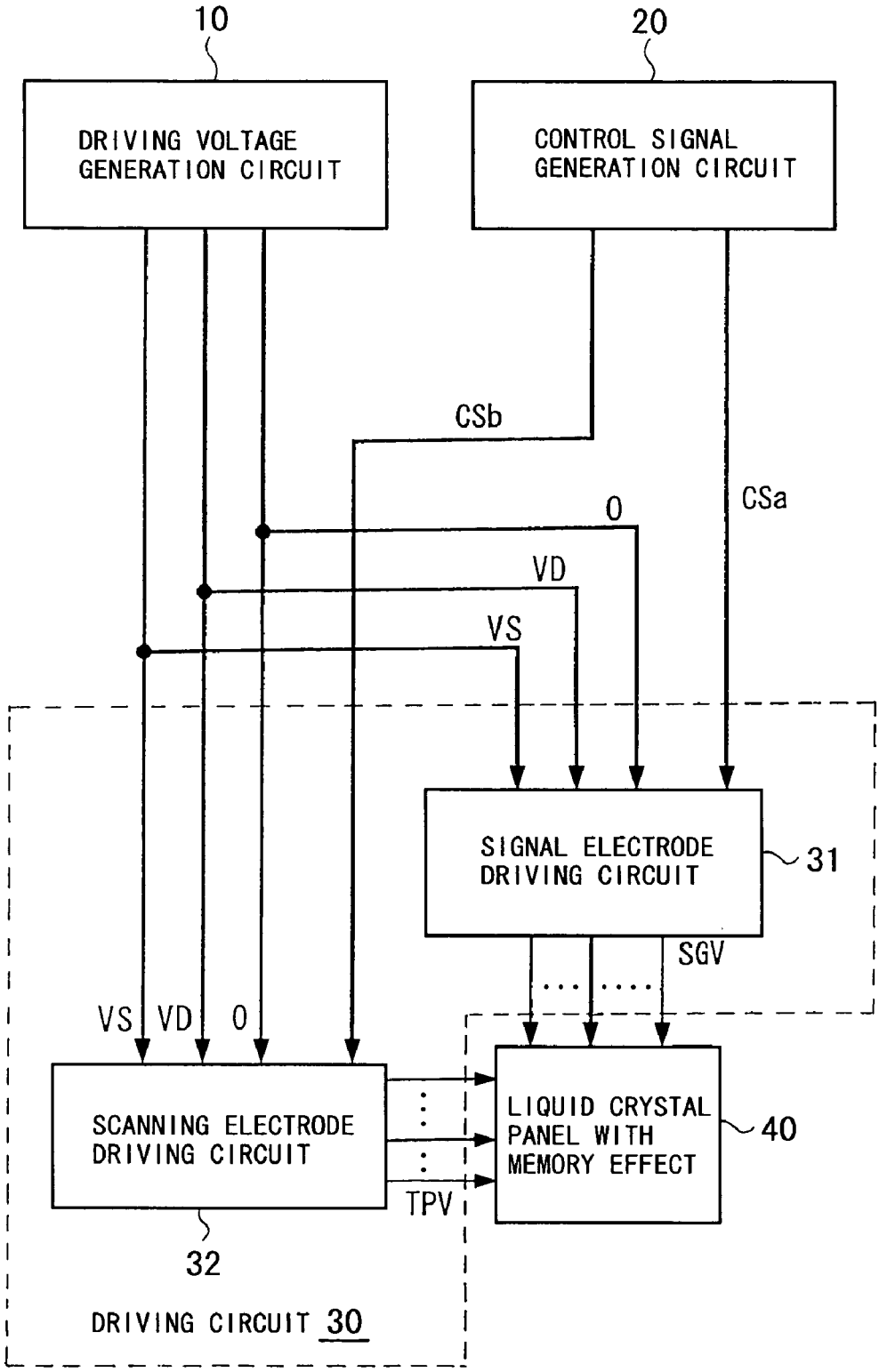
FIG. 1 is a block diagram showing a first embodiment of a liquid crystal display device according to the invention.
Figure 2:
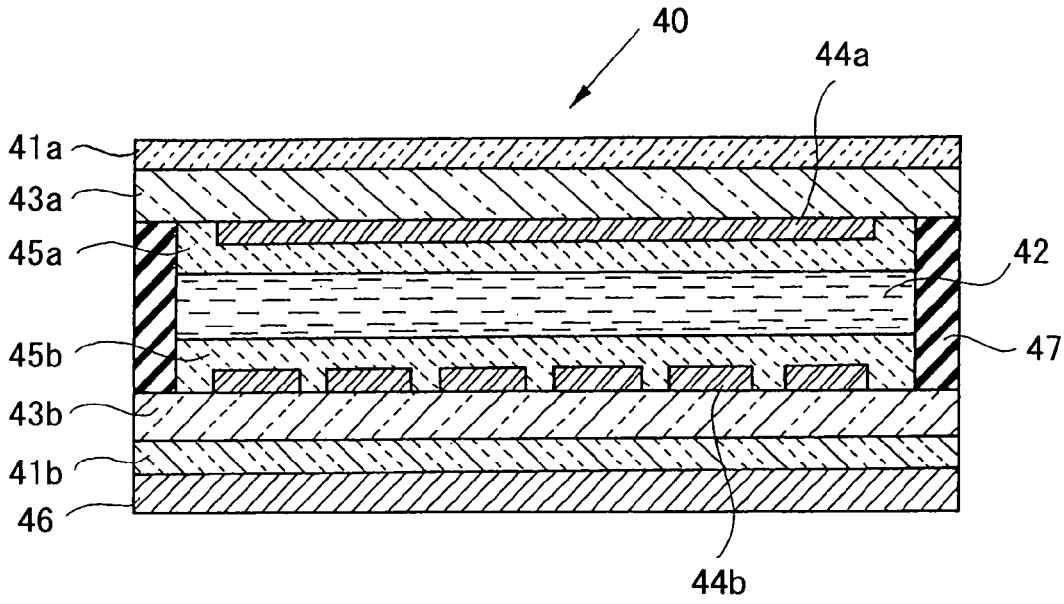
FIG. 2 is a schematic cross-sectional view showing a configuration of a liquid crystal panel with a memory effect in FIG. 1.
Figure 3:
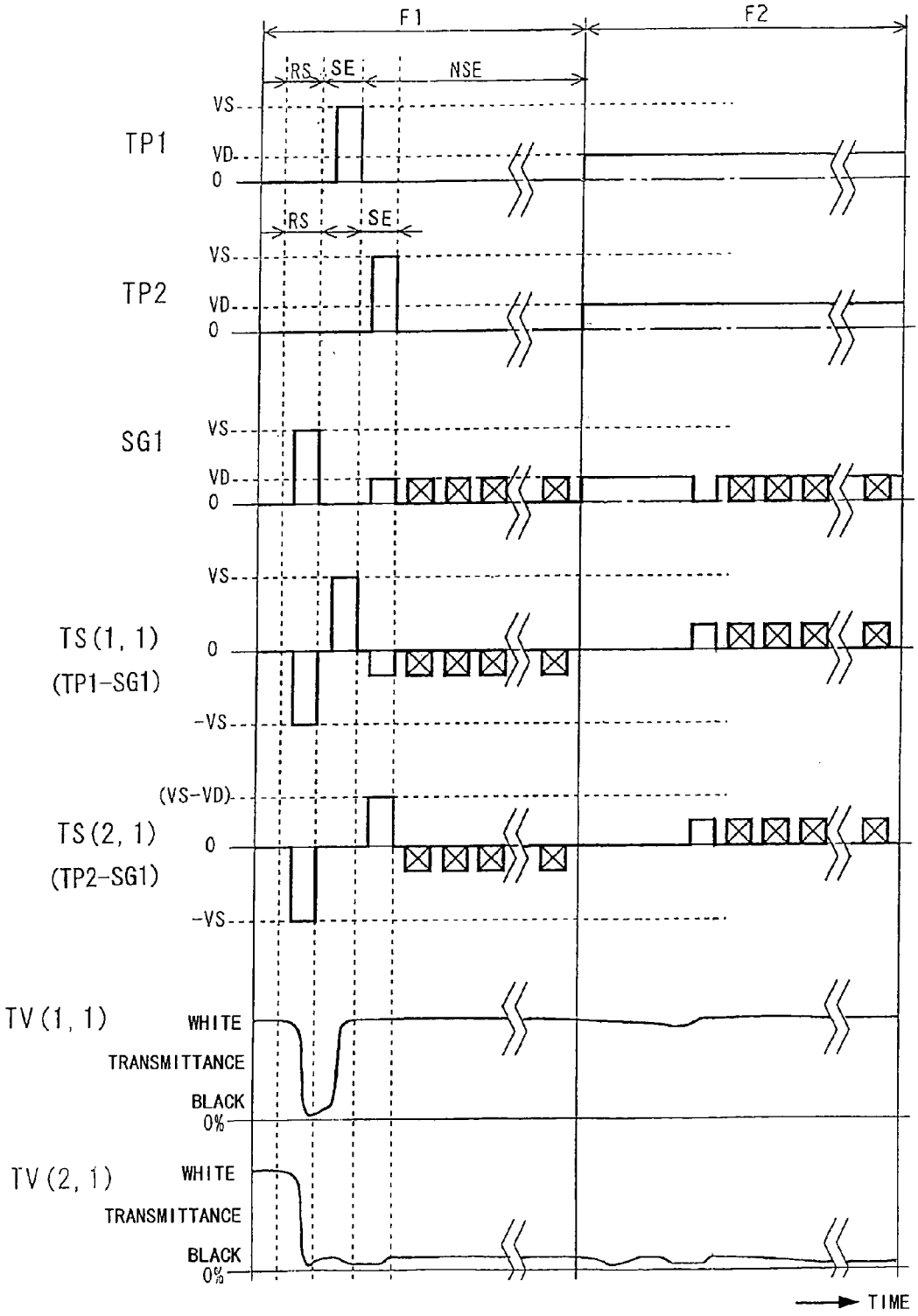
FIG. 3 is a waveform chart showing the relation between the driving voltage waveform to be applied to the liquid crystal panel with a memory effect and the transmittance in the liquid crystal display device shown in FIG. 1.
Figure 4:
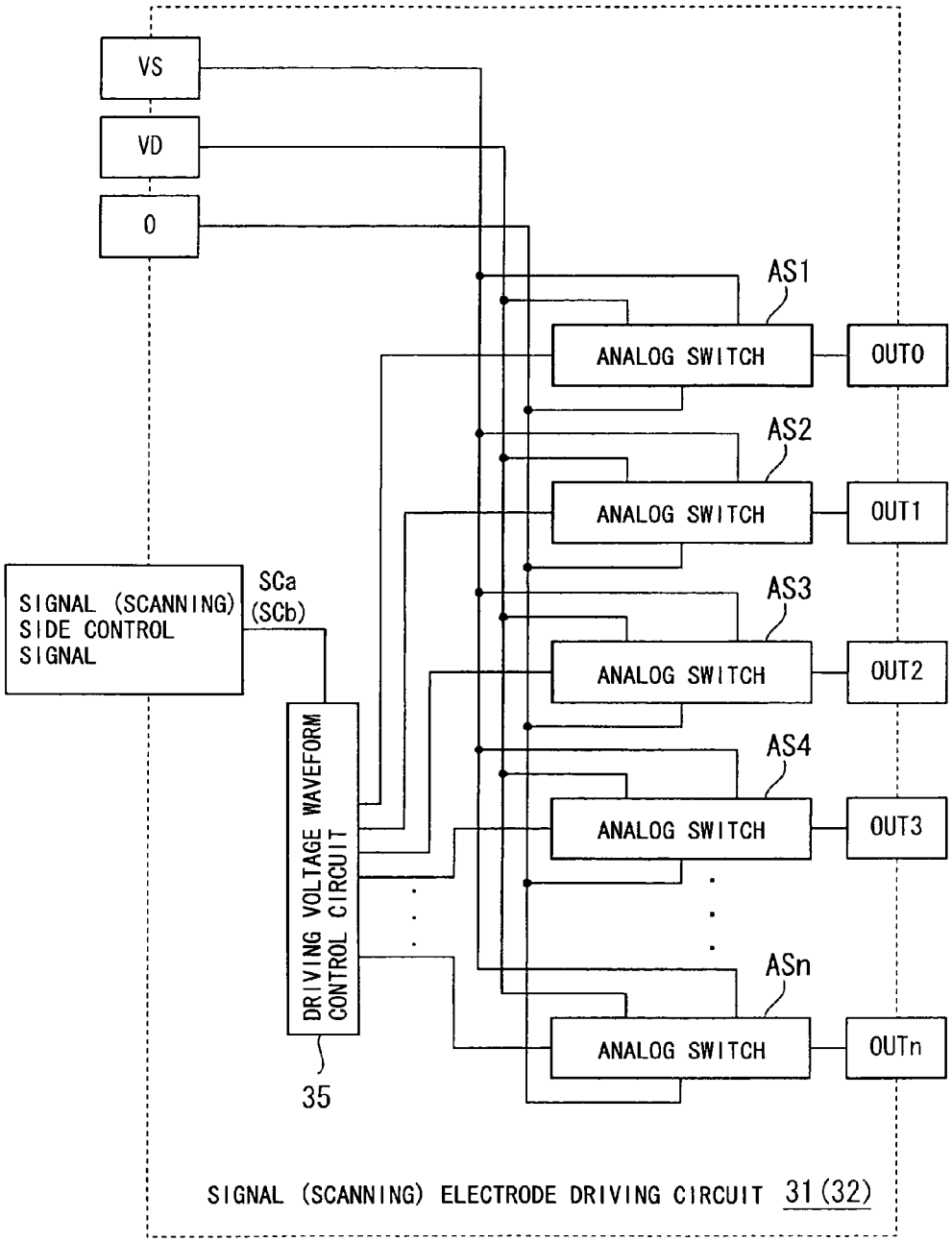
FIG. 4 is a block circuit diagram showing concrete examples of a scanning electrode driving circuit and a signal electrode driving circuit constituting the driving circuit in FIG. 1.

FIG. 1 is a block diagram showing the first embodiment of the liquid crystal display device according to the invention, and FIG. 2 is a schematic cross-sectional view showing the configuration of its liquid crystal panel with a memory effect. It should be noted that FIG. 2 shows the panel with the dimension in the thickness direction being significantly enlarged and the ratio between thicknesses of portions thereof being not precise. FIG. 3 is a waveform chart showing the relation between the driving voltage waveform to be applied to the liquid crystal panel with a memory effect and the transmittance, and FIG. 4 is a block circuit diagram showing concrete examples of a scanning electrode driving circuit and a signal electrode driving circuit constituting the driving circuit in FIG. 1.

The liquid crystal display device shown in FIG. 1 is composed of a driving voltage generation circuit 10, a control signal generation circuit 20, a driving circuit 30 composed of a signal electrode driving circuit 31 and a scanning electrode driving circuit 32, and a liquid crystal panel with a memory effect 40.

The driving voltage generation circuit 10 generates voltages of three values with the same polarity and different in level, that is, voltages zero (0), VD, and VS, and supplies the voltages to each of the signal electrode driving circuit 31 and the scanning electrode driving circuit 32 of the driving circuit 30. The control signal generation circuit 20 generates a signal side control signal CSa and a scan side control signal CSb according to image data, and inputs the signal side control signal CSa to the control terminal of the signal electrode driving circuit 31 and inputs the scan side control signal CSb to the control terminal of the scanning electrode driving circuit 32, respectively.

The signal electrode driving circuit 31 of the driving circuit 30 is controlled by the signal side control signal CSa to sequentially select required voltages from among the voltages 0, VD, and VS, and applies a signal voltage SGV having a waveform which is later described using FIG. 3, as the signal side driving signal, to many signal electrodes of the liquid crystal panel with a memory effect 40 in a parallel manner. On the other hand, the scanning electrode driving circuit 32 is controlled by the scan side control signal CSb to sequentially select required voltages from among the voltages 0, VD, and VS, and applies scanning voltages TPV having waveforms which are later described using FIG. 3, as the scan side driving signal, to many scanning electrodes of the liquid crystal panel with a memory effect 40 in a sequential manner. As described above, the driving circuit 30 synchronizes the signal voltage SGV and the scanning voltage TPV to drive the liquid crystal panel with a memory effect 40 so as to cause pixels to display image data.

The liquid crystal panel with a memory effect 40 is constituted as shown in FIG. 2. This is the same configuration as that of a typical liquid crystal panel with a memory effect, in which a pair of glass substrates 43*a* and 43*b* holding a liquid crystal layer with a memory effect 42 having a thickness of about 2 μm are bonded together with a sealing agent 47 with a fixed gap (about 2 μm) held therebetween. The opposed surfaces of the pair of glass substrates 43*a* and 43*b* are formed with scanning electrodes 44*a* and signal electrodes 44*b* made of a transparent electrode (ITO) in the form of a plurality of stripes, arranged in directions perpendicular to each other so as to form many pixels in a dot-matrix form, on which alignment films 45*a* and 45*b* are formed respectively and subjected to alignment treatment.

Figure 7:
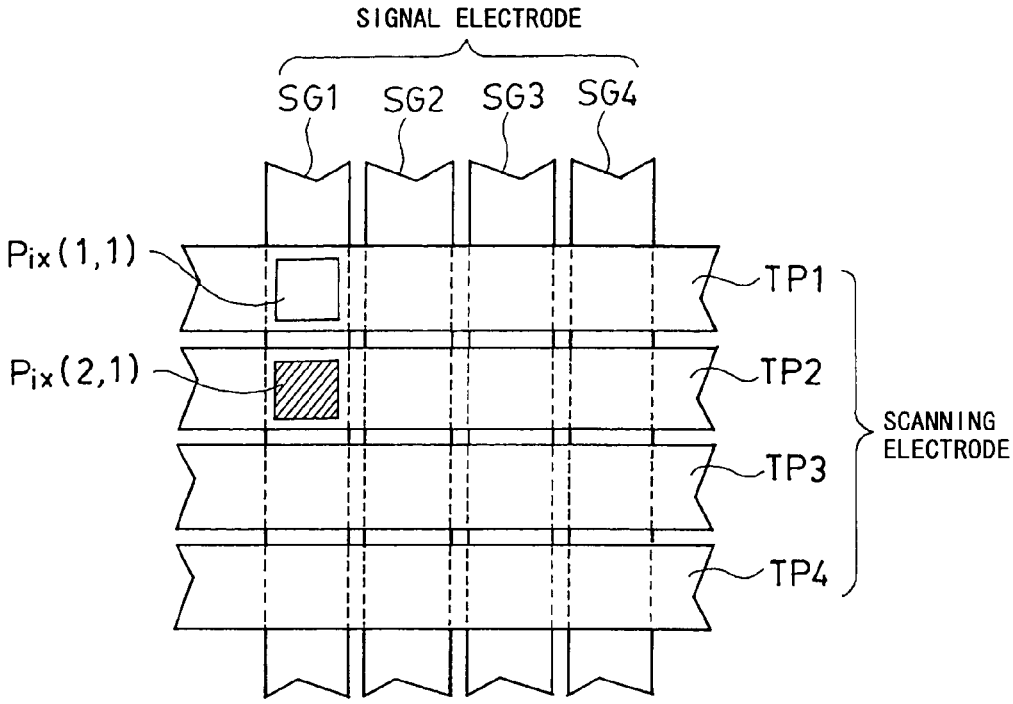
FIG. 7 RELATED ART
FIG. 7 is a plane view of portions of scanning electrodes and signal electrodes of a liquid crystal panel with a memory effect in which pixels are formed in a matrix form, as seen from a direction perpendicular to the substrate surface of the liquid crystal panel.
Figure 8:
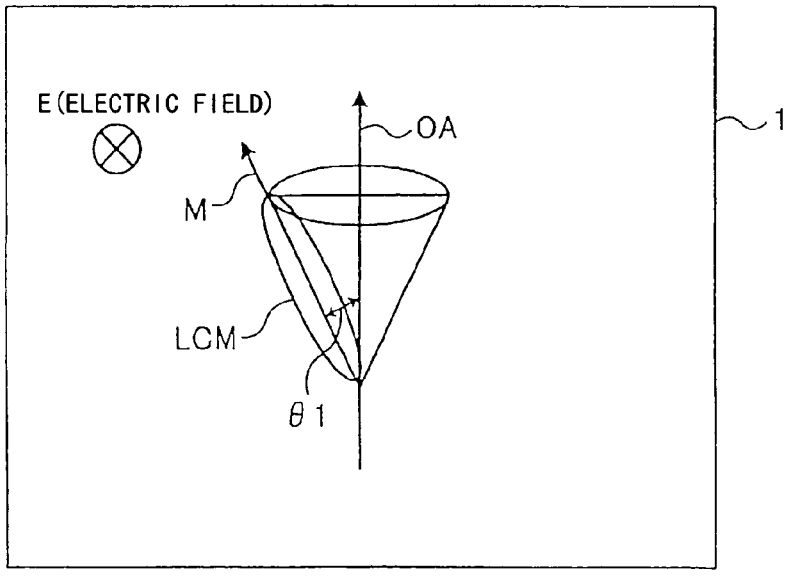
FIG. 8 RELATED ART
FIG. 8 is an explanatory view showing the relation between a molecular long axis direction of a ferroelectric liquid crystal and an electric field.
Figure 9:
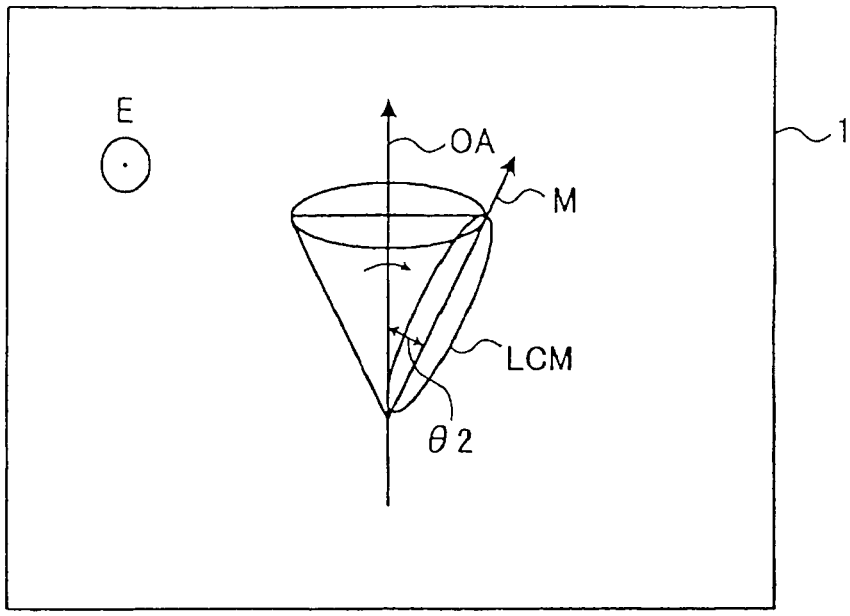
FIG. 9 RELATED ART
FIG. 9 is an explanatory view showing the relation between the molecular long axis direction of the ferroelectric liquid crystal and an electric field when the direction of the electric field is inversely directed to that in FIG. 8.
Figure 10:
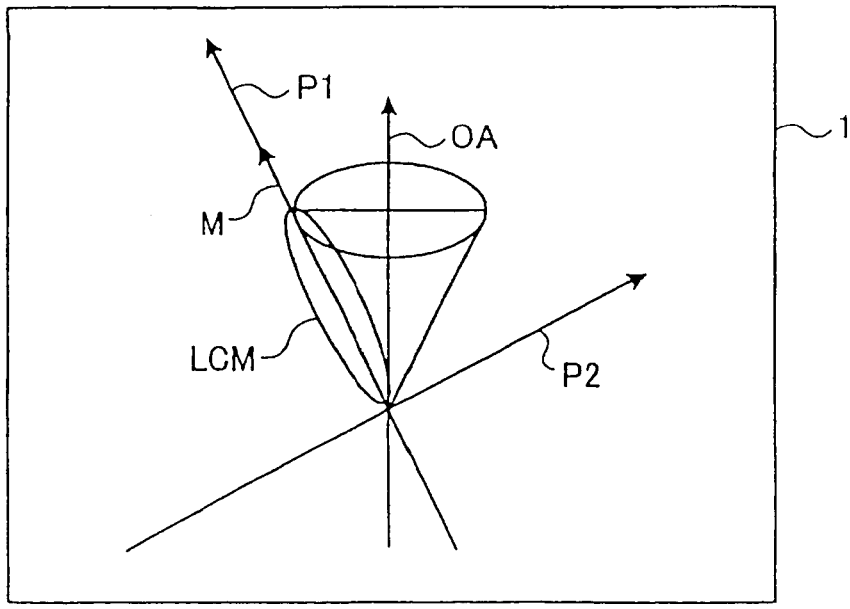
FIG. 10 RELATED ART
FIG. 10 is an explanatory view showing the relation between the molecular long axis direction of the ferroelectric liquid crystal and polarization axes of a pair of polarizing plates disposed outside a pair of substrates having the liquid crystal therebetween.

Portions where the scanning electrodes 44*a* and the signal electrodes 44*b* are opposed to each other with the liquid crystal layer with a memory effect 42 intervening therebetween, that is, portions where the scanning electrodes 44*a* and the signal electrodes 44*b* planarly overlap each other as shown in FIG. 7 form pixels Pix, respectively. Note that the scanning electrodes are shown by TP1 to TP4 and the signal electrodes are shown by SG1 to SG4 in FIG. 7.

As the liquid crystal used for the liquid crystal layer with a memory effect 42, a ferroelectric liquid crystal, a cholesteric liquid crystal, and so on can be employed.

Further, outside one of the glass substrates (hereinafter, being a first glass substrate) 43*a*, a first polarizing plate 41*a* is provided. Outside the other glass substrate (hereinafter, being a second glass substrate) 43*b*, a second polarizing plate 41*b* is provided such that its polarization axis is different by 90° C. from (perpendicular to) that of the first polarizing plate 41*a*. Outside the second polarizing plate 41*b*, a reflector 46 is disposed.

The first polarizing plate 41*a* and the second polarizing plate 41*b* are absorption-type polarizing plates which absorb linearly polarized light whose polarization direction is parallel to their absorption axes and transmit linearly polarized light whose polarization direction is parallel to their polarization axes (transmission axes) perpendicular to the absorption axes.

However, instead of the second polarizing plate 41*b* and the reflector 46, a reflection-type polarizing plate with a polarization function may be provided. The reflection-type polarizing plate has a transmission axis (polarization axis) and a reflection axis which are perpendicular to each other and thus has characteristics to transmit linearly polarized light whose polarization direction is parallel to the transmission axis and reflect linearly polarized light whose polarization direction is parallel to the reflection axis. Alternatively, the reflector 46 may be a transflective reflector disposed inside the second polarizing plate 41*b*.

Figure 11:
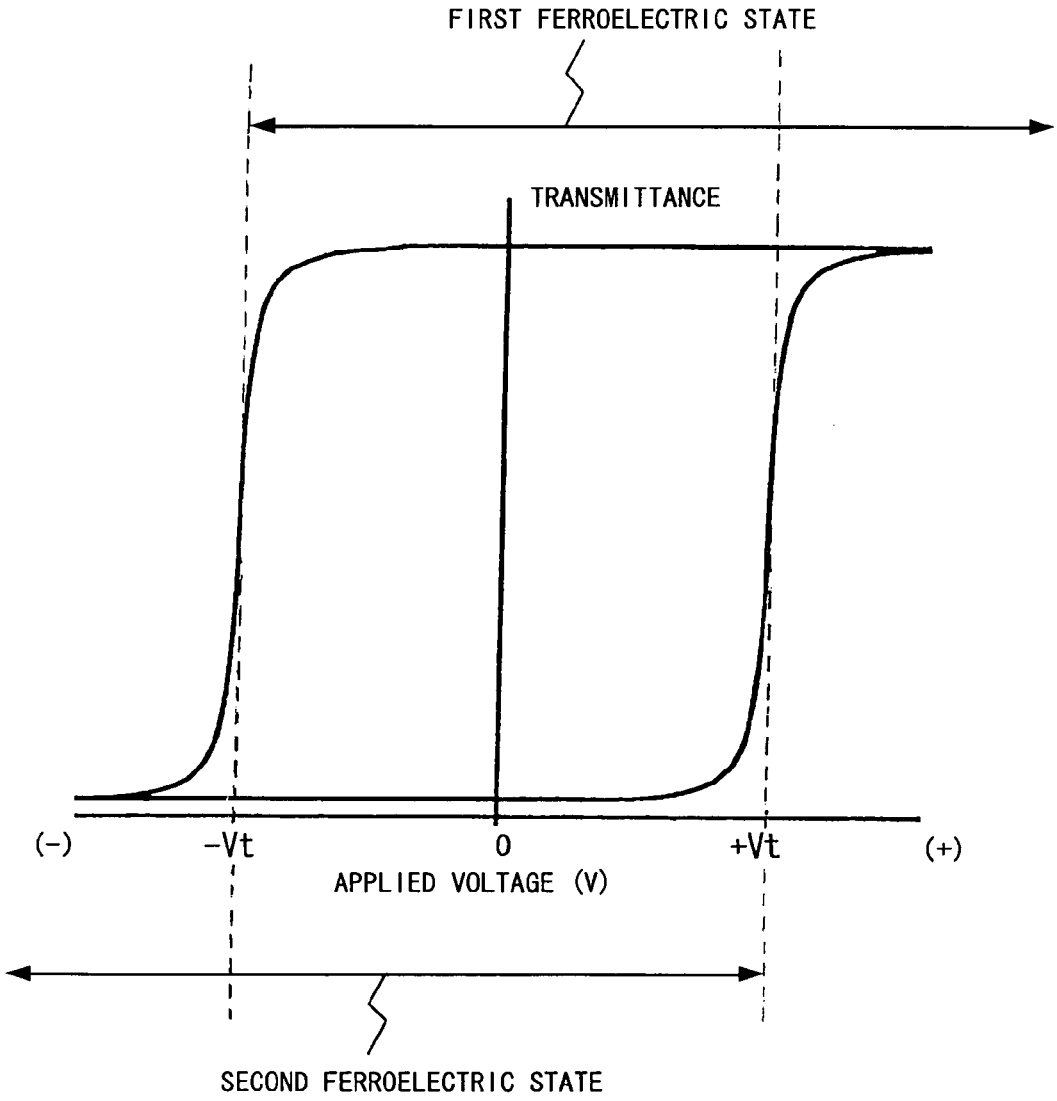
FIG. 11 RELATED ART
FIG. 11 is a characteristic chart showing the relation between the voltage applied to a liquid crystal panel in which the ferroelectric liquid crystal and the pair of polarizing plates are arranged, the transmittance, and two stable states of the ferroelectric liquid crystal.
Figure 12:
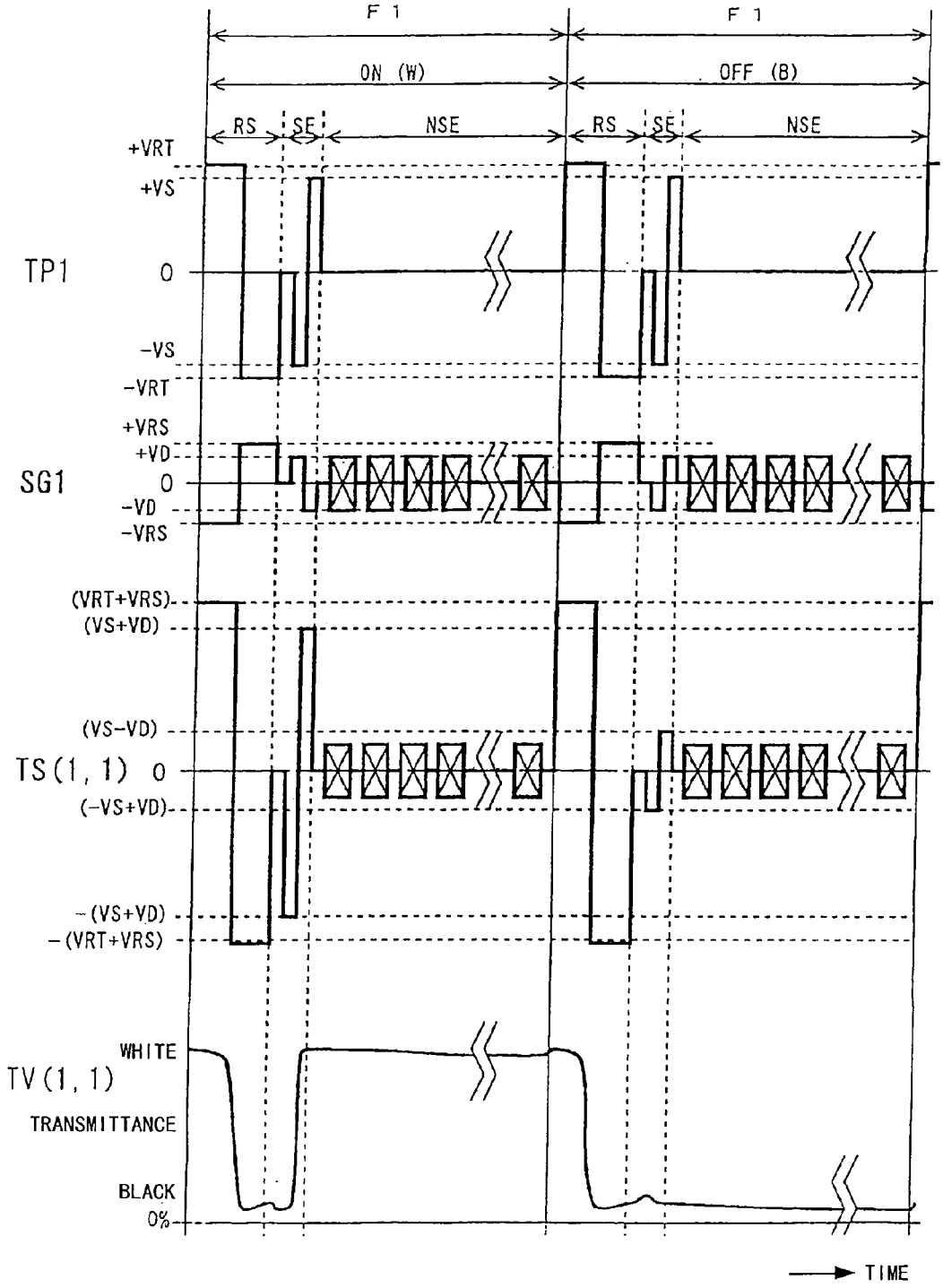
FIG. 12 RELATED ART
FIG. 12 is a waveform chart showing the relation between the driving voltage waveform to be applied to a liquid crystal panel with a memory effect and the transmittance in a conventional liquid crystal display device.

A concrete driving method of the liquid crystal panel with a memory effect 40 when a ferroelectric liquid crystal is used for the liquid crystal having a memory effect 42 will be described now using FIG. 3, FIG. 7 and FIG. 11.

In FIG. 3, TP1 shows the waveform of the scanning voltage applied to a scanning electrode TP1 in FIG. 7, TP2 similarly shows the waveform of the scanning voltage applied to a scanning electrode TP2, and SG1 shows the waveform of the signal voltage applied to a signal electrode SG1 in FIG. 7.

Further, TS (1, 1) is the waveform of the driving voltage applied to a pixel Pix (1, 1) in FIG. 7, that is, the voltage (TP1−SG1) applied between the scanning electrode TP1 and the signal electrode SG1, which is the waveform of a composite voltage of the voltage waveform of the scanning voltage applied to the scanning electrode TP1 and the voltage waveform of the signal voltage applied to the signal electrode SG1.

Further, TS (2, 1) is the waveform of the driving voltage applied to a pixel Pix (2, 1) in FIG. 7, that is, the voltage (TP2−SG1) applied between the scanning electrode TP2 and the signal electrode SG1, which is the waveform of a composite voltage of the voltage waveform of the scanning voltage applied to the scanning electrode TP2 and the voltage waveform of the signal voltage applied to the signal electrode SG1.

Further, TV (1, 1) is a transmittance waveform at the pixel Pix (1, 1) in FIG. 7, and TV (2, 1) is a transmittance waveform at the pixel Pix (2, 1) in FIG. 7.

The image data display at each pixel is displayed during a plurality of scanning periods (frames). In this embodiment, one image data is displayed during a frame F1 being the first scanning period and a frame F2 being a scanning period subsequent thereto. The frame F1 is composed of a reset period RS for bringing the liquid crystal having a memory effect at each pixel into a first stable state, a selection period SE for bringing it into the first stable state or a second stable state, and a holding period NSE for holding the stable state thereafter. During the frame F2, the stable state held during the frame F1 is held as it is.

During the frame F1, as for the waveform of the scanning voltage applied to the scanning electrode TP1, when a potential VM is defined as a reference and the potential VM is zero, the scanning voltage is at the potential VM being zero during the reset period RS. On the other hand, as for the waveform of the signal voltage applied to all of the signal electrodes SG1 to SG4, when the potential VM is defined as a reference and the potential VM is zero, the signal voltage is a pulse voltage at the potential VM being zero and at a potential +VS during the reset period. Accordingly, the waveform TS (1, 1) of the composite voltage applied to the pixel Pix (1, 1) is of a reset pulse of a voltage −VS during a second half of the reset period RS, so that if the absolute value of the voltage −VS is set to be larger than the absolute value of the threshold voltage −Vt in FIG. 11, the liquid crystal layer with a memory effect at the pixel Pix (1, 1) is brought into a second ferroelectric state (the first stable state) in which the transmittance is decreased as shown at the transmittance waveform TV (1, 1), resulting in a black image.

Subsequently, during the selection period SE of the frame F1, the voltage +VS is applied to the scanning electrode TP1, and the signal voltage to the signal electrode is at the potential VM being zero. Accordingly, the composite voltage waveform TS (1, 1) at the voltage +VS is applied as a selection pulse, so that if the absolute value of the voltage +VS is set to be larger than the absolute value of the threshold voltage Vt in FIG. 11, the liquid crystal layer with a memory effect at the pixel Pix (1, 1) is brought into a first ferroelectric state (the second stable state) in which the transmittance increases as shown at the transmittance waveform TV (1, 1), resulting in a white image.

During the holding period NSE of the frame F1, the scanning voltage is at a fixed output at the potential VM (zero), and the signal voltage is at the data voltage +VD or the potential VM (zero), so that the holding pulse of the reference VM being zero or the data voltage −VD is applied to the pixel Pix (1, 1) as the composite voltage waveform TS (1, 1). If the absolute value of the voltage −VD is set to be smaller than the absolute value of the threshold voltage −Vt in FIG. 11, the liquid crystal layer with a memory effect at the pixel Pix (1, 1) is kept in the first ferroelectric state (the second stable state), that is, the white image.

Next, a case will be described in which a pixel Pix (2, 1) at the second row and the first column in the liquid crystal panel with a memory effect shown in FIG. 7 is brought into a black image. To the pixel Pix (2, 1), a composite voltage waveform TS (2, 1) of the voltage waveform of the scanning voltage applied to the scanning electrode TP2 and the voltage waveform of the signal voltage applied to the signal electrode SG1 is applied as the driving voltage.

During the frame F1 being the first scanning period, the scanning voltage applied to the scanning electrode TP2 is at the potential VM being zero during the reset period RS. Further, the signal voltage at the potential VM being zero and at the voltage +VS is applied to all of the signal electrodes SG1 to SG4. Accordingly, during the reset period RS, the composite voltage waveform TS (2, 1) applied between the scanning electrode TP2 and the signal electrode SG1 forming the pixel Pix (2, 1) is a reset pulse of the voltages zero and −VS. If the absolute value of the voltage −VS is set to be larger than the absolute value of the threshold voltage −Vt in FIG. 11, the liquid crystal layer with a memory effect at the pixel Pix (2, 1) is brought into the second ferroelectric state (the first stable state), so that the transmittance decreases as shown at the transmittance waveform TV (2, 1), resulting in a black image.

During the subsequent selection period SE, the voltage +VS as the scanning voltage is applied to the scanning electrode TP2, and the data voltage +VD as the signal voltage is applied to the signal electrode SG1. Accordingly, the selection pulse by the composite voltage waveform TS (2, 1) is at a voltage (VS−VD). If the absolute value of the voltage is set to be smaller than the absolute value of the threshold voltage Vt in FIG. 11, the liquid crystal layer with a memory effect at the pixel Pix (2, 1) is kept in the second ferroelectric state (the first stable state), maintaining the black image.

During the holding period NSE, the potential VM (zero) as the scanning voltage is fixedly outputted, and the signal voltage is at the data voltage +VD or the potential VM (zero), so that the holding pulse of the reference VM being zero or the voltage −VD is applied to the pixel Pix (2, 1) by the composite voltage waveform TS (2, 1). However, since the absolute value of the voltage −VD is smaller than the absolute value of the threshold voltage −Vt in FIG. 11, the liquid crystal layer with a memory effect at the pixel Pix (2, 1) is kept in the second ferroelectric state (the first stable state), maintaining the black image.

In the frame F2, the scanning voltage at the fixed value of the voltage +VD is applied to any of the scanning electrodes TP1 and TP2 during the whole period, and the signal voltage of the data voltage +VD or the potential VM (zero) is applied to the signal electrode SG1. Accordingly, any of the composite voltage waveforms TS (1, 1) and TS (2, 1) is a holding pulse of the reference VM being zero or the voltage +VD. However, since the absolute value at the voltage +VD is smaller than the absolute value of the threshold voltage Vt in FIG. 11, the liquid crystal layer with a memory effect at any of the pixels Pix (1, 1) and Pix (2, 1) is kept in the ferroelectric state (stable state) during the holding period of the frame F1 so that the pixel Pix (1, 1) is kept in the white image and the pixel Pix (2, 1) is kept in the black image.

In either case in which the pixel is brought into the white image or the black image, the pulse waveform of the signal voltage during the reset period RS and the pulse waveform of the scanning voltage during the selection period are made the same pulse waveform with the same pulse width and pulse voltage. The setting like this enables inversion of the polarity of the applied voltage between the reset period and the selection period, as in the composite voltage waveforms TS (1, 1) and TS (2, 1).

Incidentally, in the composite voltage waveform TS (2, 1) when the black image is selected, the absolute value of the positive selection pulse is strictly smaller than the absolute value of the negative reset pulse. Accordingly, to appropriately invert the polarity for this portion, the image data to be displayed at the pixel is displayed during a plurality of scanning periods during which the polarity of the applied voltage is inverted in this embodiment.

More specifically, the polarities of the composite waveforms TS (1, 1) and TS (2, 1) to be applied between the scanning electrode and the signal electrode at a portion forming the pixel during the frame F1 being the first scanning period and during the frame F2 being the scanning period subsequent thereto are inverted.

As shown in FIG. 3, the image data displayed at the pixel during a plurality of scanning periods (the frames F1 and F2 which are two scanning periods in FIG. 3), and the reset pulse and the selection pulse are applied during the frame F1 being the first scanning period of the plurality of scanning periods. Further, in both the voltage waveforms of the scanning voltage and the signal voltage, the reference voltage as a reference in the frame F2 being the second or later period is made equal to the data voltage VD applied as the signal voltage during the first scanning period.

In particular, during the second or later scanning period, the reference voltage of the scanning voltage is set to the voltage +VD so that the fixed voltage +VD is applied to the scanning electrode. Although the reference voltage is set to the voltage +VD also for the signal voltage, the voltage +VD is defined as a reference and the signal voltage with an inverted waveform with respect to the signal voltage waveform when the reset pulse applied during the first scanning period is removed is applied to the signal electrode.

More specifically, when the data potential VM (zero) is outputted as the signal side voltage waveform during the selection period SE of the frame F1 being the first scanning period, the data voltage +VD is outputted at the same timing as the selection period SE during the frame F2 being the second scanning period. Similarly, when the data voltage +VD is outputted as the signal side voltage waveform during the selection period SE of the frame F1 being the first scanning period, the potential VM (zero) is outputted at the same timing as the selection period SE during the frame F2 being the second scanning period. Such setting allows alternating driving in two frames in the composite voltage waveform. This enables the waveform after the reset during the frame F1 to be compensated during the frame F2.

Note that the transmittance waveforms TV (1, 1) and TV (2, 1) are waveforms of the transmittance of light which are detected by a photodetector or the like, when the driving voltages of the above-described composite voltage waveforms are applied between the scanning electrodes and the signal electrode forming the pixels Pix (1, 1) and Pix (2, 1) of the ferroelectric liquid crystal panel.

The combination of the pulse voltage applied to the signal electrode during the reset period and the pulse voltage applied to the scanning electrode during the selection period enables display in any color (white or black) at any pixel as well as alternating driving as described above. Therefore, when drivers IC for driving liquid crystal are used to apply the driving voltages to the signal electrodes and scanning electrodes, each of the drivers IC can be operated by only voltage with one polarity, that is, a positive voltage (or negative voltage). Accordingly, the withstand voltage of each driver IC can be restrained to low, resulting in a reduction in chip size of the IC. Further, the ICs can be configured the same. Furthermore, all of the voltages for pulses have the same polarity, so that boosting circuits for generating the voltages can be easily manufactured and the power consumption of the whole system can be reduced.

In this embodiment, either of the voltage waveform of the scanning voltage TPV outputted by the scanning electrode driving circuit 32 of the driving circuit 30 shown in FIG. 1 and the voltage waveform of the signal voltage SGV outputted by the signal electrode driving circuit 31 is composed of three values which are a voltage zero (0), a first positive or negative voltage VD smaller in absolute value than the threshold voltages Vt and −Vt at which the stable state of the ferroelectric liquid crystal being the liquid crystal having a memory effect changes, and a second voltage VS having the same polarity as that of the first voltage VD and being larger in absolute value than the aforementioned threshold voltages Vt and −Vt, where $|VS-VD|<|Vt|$ and $|VS|>|VD|$.

Concrete examples of the signal electrode driving circuit 31 for outputting the signal voltage and the scanning electrode driving circuit 32 for outputting the scanning voltage which are described above will be described now using FIG. 4. The signal electrode driving circuit 31 and the scanning electrode driving circuit 32 are driver ICs having the same configuration and compatibility with each other. Each of them is composed of a driving voltage waveform control circuit 35 and analog switches AS1 to ASn each of which forms a selector circuit. Assuming that the number of the signal electrodes 44*b* or the scanning electrodes 44*a* of the liquid crystal panel with a memory effect 40 shown in FIG. 2 is n, the number of the analog switches AS1 to ASn provided corresponds to the aforementioned number n.

Each of the analog switches AS1 to ASn, to which the voltages zero (0), VD, and VS outputted from the driving voltage generation circuit 10 shown in FIG. 1 are applied, is controlled by the signal side control signal SCa or the scan side control signal SCb from the control signal generation circuit 20 shown in FIG. 1 to sequentially select required voltages to make them outputs OUT1 to OUTn of the signal voltage to be applied to the signal electrodes 44*b* or the scanning voltage to be applied to the scanning electrodes 44*a*, in response to the select signals outputted by the driving voltage waveform control circuit 35.

According to this embodiment, each of the voltage waveforms of the scanning voltage and the signal voltage outputted by the driving circuit 30 to drive the liquid crystal panel with a memory effect 40 can be unipolar, that is, positive or negative; the level values of the voltages forming each of the voltage waveforms, that is, the kinds of the voltages can be three values (0, VD, and VS) even including both the aforementioned voltages; and each of the voltage waveforms can be made simple as shown in FIG. 3.

Accordingly, the driver ICs of the scanning electrode driving circuit 32 and the signal electrode driving circuit 31 can be reduced in size and manufactured at low cost. This allows a liquid crystal display device provided with the liquid crystal panel with a memory effect 40 to be provided at low cost. In addition, the scanning electrode driving circuit 32 and the signal electrode driving circuit 31 can be configured the same to have compatibility with each other so that one can be used for both of them, further reducing the cost.

Second Embodiment

A second embodiment of the invention will be described using FIG. 5 and FIG. 6.

Figure 5:
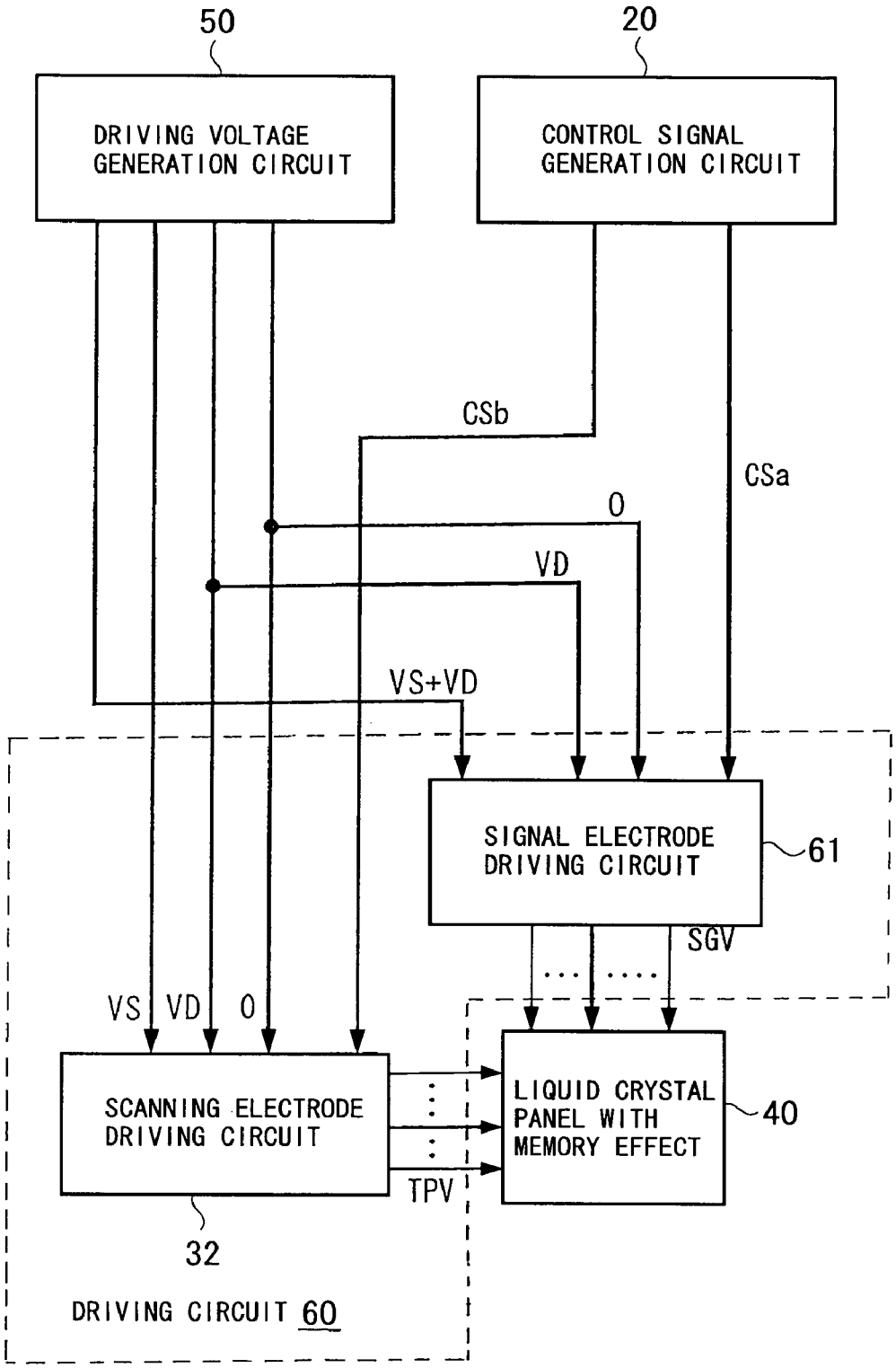
FIG. 5 is a block diagram showing a second embodiment of the liquid crystal display device according to the invention.
Figure 6:
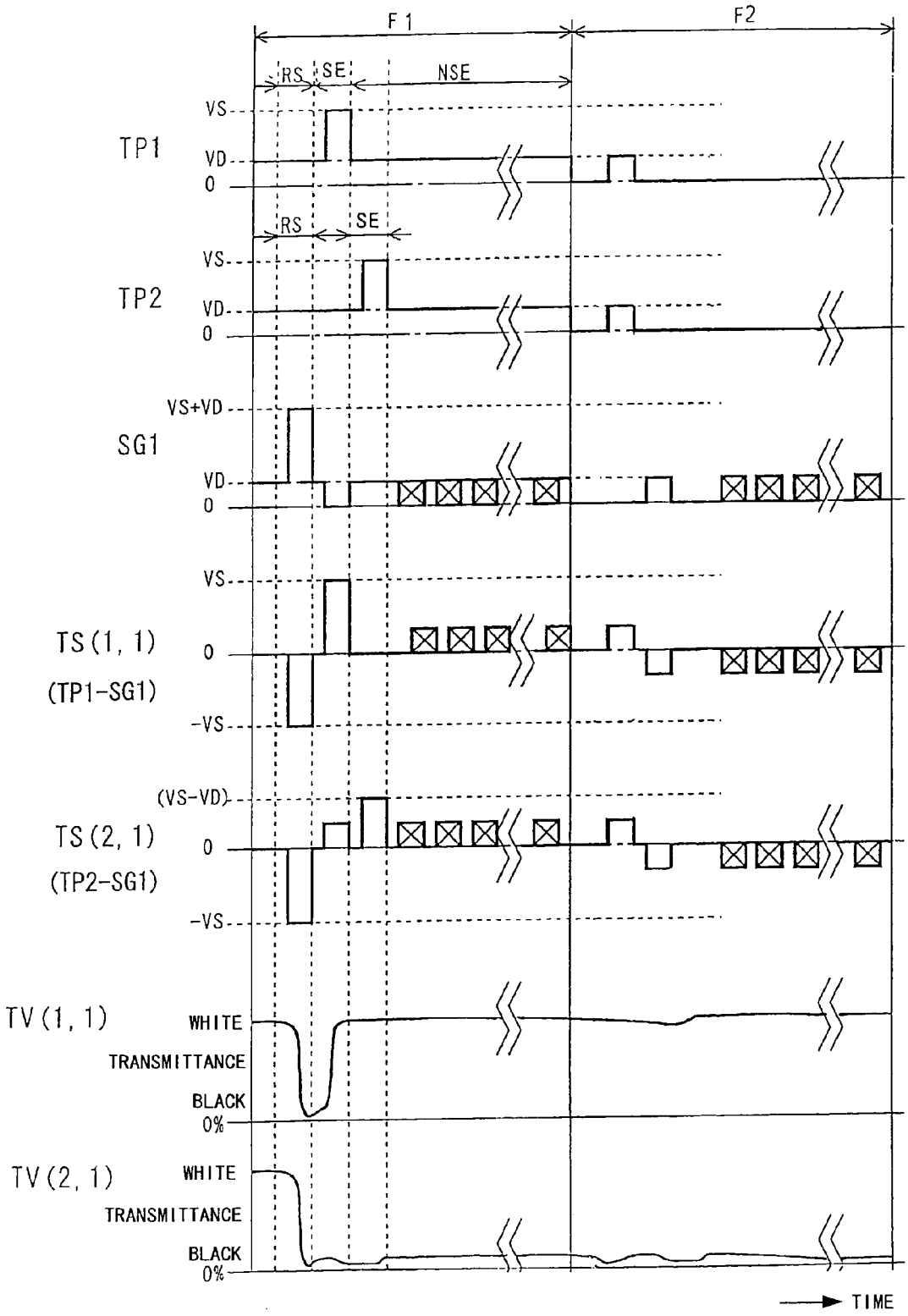
FIG. 6 is a waveform chart showing the relation between the driving voltage waveform to be applied to the liquid crystal panel with a memory effect and the transmittance in the liquid crystal display device shown in FIG. 5.

FIG. 5 is a block diagram showing the second embodiment of the liquid crystal display device according to the invention, and FIG. 6 is a waveform chart, similar to that in FIG. 3, showing the relation between the driving voltage waveform to be applied to the liquid crystal panel with a memory effect and the transmittance in the liquid crystal display device shown in FIG. 5.

The embodiment shown in FIG. 5 is different from the first embodiment shown in FIG. 1 only in a driving voltage generation circuit 50 and a signal electrode driving circuit 61 of a driving circuit 60, and is the same as the first embodiment in FIG. 1 in other portions. Therefore, the same numerals and figures are assigned to those portions and description thereof is omitted.

The driving voltage generation circuit 50 generates voltages of four values with the same polarity and different in level, that is, a voltage zero (0), a first voltage (data voltage) VD, a second voltage VS, and a third voltage VS +VD made by adding the second voltage VS and the first voltage VD, and supplies the voltage zero (0), the first voltage VD, and the second voltage VS to the scanning electrode driving circuit 32 and supplies the voltage zero (0), the first voltage VD, and the third voltage VS+VD to the signal electrode driving circuit 61.

The signal electrode driving circuit 61 of the driving circuit 60 is controlled by the signal side control signal CSa to select voltages required for the reset voltage, the data voltage, and the reference voltage from among the voltages 0, VD, and VS+VD, and sequentially applies a signal voltage SGV having a waveform which is later described using FIG. 6, as the signal side driving signal, to many signal electrodes of the liquid crystal panel with a memory effect 40 in a parallel manner. The signal voltage SGV becomes the signal voltage waveform after changing in a certain cycle.

On the other hand, a scanning electrode driving circuit 32 is controlled by the scan side control signal CSb as in the first embodiment to sequentially select voltages required for the selection voltage, the data voltage, and the reference voltage from among the voltages 0, VD, and VS, and sequentially applies scanning voltages TPV having waveforms which are later described using FIG. 6, as the scan side driving signal, to many scanning electrodes of the liquid crystal panel with a memory effect 40. The scanning voltage TPV becomes the scanning voltage waveform after changing in a certain cycle.

As described above, the driving circuit 60 drives the liquid crystal panel with a memory effect 40 by means of the signal voltage SGV and the scanning voltage TPV to cause each pixel to display image data.

Concrete circuit examples of the signal electrode driving circuit 61 and the scanning electrode driving circuit 32 are the same as the circuit shown in FIG. 4. Incidentally, in the case of the signal electrode driving circuit 61, the third voltage VS+VD is inputted thereto instead of the second voltage VS, and applied to analog switches AS1 to ASn.

A concrete driving method of the liquid crystal panel with a memory effect using the ferroelectric liquid crystal according to the second embodiment will be described now using FIG. 6.

Waveforms of TP1, TP2, SG1, TS (1, 1), TS (2, 1), TV (1, 1) and TV (2, 1) in FIG. 6 indicate the same meaning as those in FIG. 3.

Also in this embodiment, the image data displayed at each pixel is displayed during a plurality of scanning periods (frames). In this embodiment, one image data is displayed during a frame F1 being the first scanning period and a second frame F2 being a scanning period subsequent thereto. The frame F1 is composed of a reset period RS for bringing the liquid crystal having a memory effect at each pixel into a first stable state, a selection period SE for bringing it into the first stable state or a second stable state, and a holding period NSE for holding the stable state thereafter. During the frame F2, the stable state held during the frame F1 is held as it is.

In the embodiment shown in FIG. 6, during the frame F1 being the first scanning period, the voltage VS+VD of the reset pulse on the signal electrode SGn side during the reset period (RS) is different from the voltage VS of the selection pulse on the scanning electrode TPn side during the selection period SE.

Also in this case, in order to allow alternating driving the reference voltage during the frame F1 being the first scanning period is set to the first voltage (data voltage) VD, and the reference voltage during the frame F2 being the subsequent scanning period is set to zero (0) which is made different from the above value. Further, the reset pulse of the voltage VD is applied to the scanning electrode during the frame F2.

Other operations are the same as those in the first embodiment described with FIG. 3 and therefore the description thereof is omitted.

The relation of magnitude of absolute values between the first voltage VD, the second voltage VS, and the threshold voltages. Vt and −Vt at which the stable state of the ferroelectric liquid crystal in FIG. 11 changes is the same as that of the above-described first embodiment. Namely, $|VS|>|Vt|$, $|VS-VD|<|Vt|$, $|VS|>|VD|$, and $|VD|<|Vt|$.

Also in this embodiment, the same effects as those in the first embodiment can be attained except for that the level values of the voltages forming the voltage waveforms of the scanning voltage and the signal voltage outputted by the driving circuit 60 to drive the liquid crystal panel with a memory effect 40, that is, the kinds of the voltages can be four values (0, VD, VS, and VS+VD) including both the aforementioned voltages. Even in this case, as compared to the kinds of the voltages constituting the voltage waveforms of the scanning voltage and the signal voltage in the conventional liquid crystal display device of this kind, the kinds of voltages can be reduced and the voltage waveforms can be made simple as shown in FIG. 6.

Accordingly, the driver ICs of the scanning electrode driving circuit 32 and the signal electrode driving circuit 61 can be reduced in size and manufactured at low cost. This allows a liquid crystal display device provided with the liquid crystal panel with a memory effect 40 to be provided at low cost. In addition, the scanning electrode driving circuit 32 and the signal electrode driving circuit 61 can be configured the same to have compatibility with each other so that one can be used for both of them, further reducing the cost.

Although the case in which the ferroelectric liquid crystal is used for the liquid crystal layer with a memory effect of the liquid crystal panel with a memory effect has been described in each of the embodiments, other liquid crystal having a memory effect such as a cholesteric liquid crystal or the like may be used. In that case, the above-described absolute values of the first voltage VD and the second voltage VS can be set in consideration of the threshold voltages at which the stable state of the liquid crystal having a memory effect in use changes.

EFFECT OF THE INVENTION

The liquid crystal display device and the driving circuit for its liquid crystal panel with a memory effect according to the invention can be used for various kinds of devices for displaying static images with less change, and is particularly useful for the display device of a personal digital assistant and especially suitable for a terminal device which is required to be continuously used for a long time even when driven with batteries, such as an electronic book and an electronic dictionary. Further, the liquid crystal display device, in which rewriting of screen is not so often, can realize excellent display without flicker of the screen.

What is claimed is:

1. A liquid crystal display device comprising:

a liquid crystal panel with a memory effect including:

a liquid crystal having a memory effect being a ferroelectric liquid crystal having at least two stable states;

a pair of substrates sandwiching said liquid crystal having a memory effect, said pair of substrates having scanning electrodes and signal electrodes on opposed surfaces respectively, portions thereof where said scanning electrodes are opposed to said signal electrodes with said liquid crystal having a memory effect intervening therebetween forming pixels; and a driving circuit for driving said liquid crystal panel with a memory effect to cause said pixels to display image data, wherein said driving circuit applies, to said scanning electrode of said liquid crystal panel with a memory effect, a scanning voltage of a voltage waveform composed of a voltage zero and only one of positive or negative unipolar voltage consistently across a plurality of scanning periods, and also, to said signal electrode, a signal voltage of a voltage waveform composed of a voltage zero and a unipolar voltage having the same polarity as the polarity of the scanning voltage consistently across the plurality of scanning periods, wherein the image data displayed at said pixel is displayed during the plurality of scanning periods, the voltage applied between said scanning electrode and said signal electrode forming said pixel during the plurality of scanning periods is alternating voltage, wherein a waveform of the voltage applied between said scanning electrode and said signal electrode during a first scanning period and a subsequent scanning period is asymmetrical, wherein an absolute value of the voltage applied between said scanning electrode and said signal electrode during the subsequent scanning period is smaller than an absolute value of a threshold voltage of said ferroelectric liquid crystal, and wherein a white or black image displayed by any of said pixels is kept in a same state during said plurality of scanning periods.

2. The liquid crystal display device according to claim 1, wherein a reference potential of the scanning voltage during the first scanning period outputted by said driving circuit is different from a reference potential of the scanning voltage during the subsequent scanning period.

3. The liquid crystal display device according to claim 1, wherein a reference potential of the signal voltage during the first scanning period outputted by said driving circuit is different from a reference potential of the signal voltage during the subsequent scanning period.

4. The liquid crystal display device according to claim 1, wherein a composite waveform of the voltage waveform of the scanning voltage and the voltage waveform of the signal voltage outputted by said driving circuit is a waveform of a composite voltage applied between said scanning electrode and signal electrode at the portion forming said pixel, wherein one scanning period of the plurality of scanning periods includes a reset period for bringing said liquid crystal having a memory effect at said pixel into a first stable state and a selection period for bringing said liquid crystal having a memory effect at said pixel into the first stable state or a second stable state, wherein the waveform of the composite voltage has a reset pulse during the reset period and has a selection pulse during the selection period, wherein the reset pulse is composed of the voltage waveform of the signal voltage with the scanning voltage being zero, and wherein the selection pulse is composed of the voltage waveform of the scanning voltage with the signal voltage being zero.

5. The liquid crystal display device according to claim 4, wherein the reset pulse during the reset period and the selection pulse during the selection period are equal in pulse width and pulse voltage.

6. The liquid crystal display device according to claim 4, wherein each of the voltage waveform of the scanning voltage and the voltage waveform of the signal voltage outputted by said driving circuit is composed of three values which are a voltage zero, a first positive or negative voltage (VD) smaller in absolute value than threshold voltages at which the stable state of said liquid crystal having a memory effect changes, and a second voltage (VS) having the same polarity as the polarity of the first voltage and being larger in absolute value than the threshold voltages.

7. The liquid crystal display device according to claim 1, wherein a composite waveform of the voltage waveform of the scanning voltage and the voltage waveform of the signal voltage outputted by said driving circuit is a waveform of a composite voltage applied between said scanning electrode and signal electrode at the portion forming said pixel, wherein one scanning period of the plurality of scanning periods includes a reset period for bringing said liquid crystal having a memory effect at said pixel into a first stable state and a selection period for bringing said liquid crystal having a memory effect at said pixel into the first stable state or a second stable state, wherein the waveform of the composite voltage has a reset pulse during the reset period and has a selection pulse during the selection period, wherein the reset pulse is composed of a first positive or negative voltage (VD) smaller in absolute value than threshold voltages at which the stable state of said liquid crystal having a memory effect changes, as the scanning voltage, and a third voltage (VD +VS) made by adding the first voltage and a second voltage (VS) having the same polarity as the polarity of the first voltage and being larger in absolute value than the threshold voltages, as the signal voltage, and wherein the selection pulse is composed of the second voltage (VS) as the scanning voltage, and zero or the first voltage (VD) as the signal voltage.

8. The liquid crystal display device according to claim 4, wherein the reset pulse and the selection pulse are applied during the first scanning period of the plurality of scanning periods.

9. The liquid crystal display device according to claim 7, wherein the reset pulse and the selection pulse are applied during the first scanning period of the plurality of scanning periods.

10. The liquid crystal display device according to claim 7, wherein each of the voltage waveform of the scanning voltage and the voltage waveform of the signal voltage outputted by said driving circuit is composed of four values which are the voltage zero, the first voltage (VD), the second voltage (VS), and the third voltage (VD+VS).

11. The liquid crystal display device according to claim 6, wherein a reference potential of the scanning voltage during the first scanning period outputted by said driving circuit is different from a reference potential of the scanning voltage during the subsequent scanning period, and each of the reference potentials is the voltage zero or the first voltage (VD).

12. The liquid crystal display device according to claim 10, wherein a reference potential of the scanning voltage during the first scanning period outputted by said driving circuit is different from a reference potential of the scanning voltage during the subsequent scanning period, and each of the reference potentials is the voltage zero or the first voltage (VD).

13. The liquid crystal display device according to claim 1, wherein said liquid crystal having a memory effect is a ferroelectric liquid crystal.

14. A driving circuit for a liquid crystal panel with a memory effect, said liquid crystal panel including a liquid crystal having a memory effect being a ferroelectric liquid crystal having at least two stable states sandwiched between a pair of substrates having scanning electrodes and signal electrodes on opposed surfaces respectively, portions thereof where said scanning electrodes are opposed to said signal electrodes forming pixels, said driving circuit comprising:

a scanning electrode driving circuit for applying a scanning voltage to said scanning electrodes, and a signal electrode driving circuit for applying a signal voltage to said signal electrodes, said scanning electrode driving circuit outputting a scanning voltage of a voltage waveform composed of a voltage zero and only one of positive or negative unipolar voltage consistently across a plurality of scanning periods, and said signal electrode driving circuit outputting a signal voltage of a voltage waveform composed of a voltage zero and a unipolar voltage having the same polarity as the polarity of the scanning voltage consistently across the plurality of scanning periods, wherein a composite voltage of the scanning voltage and the signal voltage outputted during the plurality of scanning periods is applied between said scanning electrode and said signal electrode at the portion forming said pixel to cause said pixel to display data, wherein the composite voltage applied between said scanning electrode and said signal electrode at the portion forming said pixel during the plurality of scanning periods is alternating voltage, and wherein a waveform of the composite voltage applied between said scanning electrode and said signal electrode during a first scanning period and a subsequent scanning period is asymmetrical, wherein an absolute value of the composite voltage applied between said scanning electrode and said signal electrode during the subsequent scanning period is smaller than an absolute value of a threshold voltage of said ferroelectric liquid crystal, and wherein a white or black image displayed by any of said pixels is kept in a same state during said plurality of scanning periods.

15. The driving circuit for a liquid crystal panel with a memory effect according to claim 14, wherein a reference potential of the scanning voltage outputted during the first scanning period by said scanning electrode driving circuit is different from a reference potential of the scanning voltage outputted during the subsequent scanning period.

16. The driving circuit for a liquid crystal panel with a memory effect according to claim 14, wherein a reference potential of the signal voltage during the first scanning period outputted by said signal electrode driving circuit is different from a reference potential of the signal voltage during the subsequent scanning period.

17. The driving circuit for a liquid crystal panel with a memory effect according to claim 14, wherein a composite waveform of the voltage waveform of the scanning voltage and the voltage waveform of the signal voltage is a waveform of a composite voltage applied between said scanning electrode and signal electrode at the portion forming said pixel, wherein one scanning period of the plurality of scanning periods includes a reset period for bringing said liquid crystal having a memory effect at said pixel into a first stable state and a selection period for bringing said liquid crystal having a memory effect at said pixel into the first stable state or a second stable state, wherein during the reset period, said scanning electrode driving circuit brings the scanning voltage to a voltage zero, and said signal electrode driving circuit brings the signal voltage to a voltage (VS) larger in absolute value than threshold voltages at which the stable state of said liquid crystal having a memory effect changes, and wherein during the selection period, said scanning electrode driving circuit brings the scanning voltage to a voltage (VS) larger in absolute value than the threshold voltages at which the stable state of said liquid crystal having a memory effect changes, and said signal electrode driving circuit brings the signal voltage to a voltage zero.

18. The driving circuit for a liquid crystal panel with a memory effect according to claim 17, wherein the voltage of the signal voltage outputted by said signal electrode driving circuit during the reset period is equal to the voltage of the scanning voltage outputted by said scanning electrode driving circuit during the selection period.

19. The driving circuit for a liquid crystal panel with a memory effect according to claim 17, wherein the voltages outputted by each of said scanning electrode driving circuit and said signal electrode driving circuit are three values which are a voltage zero, a voltage (VD) smaller in absolute value than the threshold voltages at which the stable state of said liquid crystal having a memory effect changes, and the voltage (VS) larger in absolute value than the threshold voltages at which the stable state of said liquid crystal having a memory effect changes.

20. The driving circuit for a liquid crystal panel with a memory effect according to claim 14, wherein a composite waveform of the voltage waveform of the scanning voltage and the voltage waveform of the signal voltage is a waveform of a composite voltage applied between said scanning electrode and signal electrode at the portion forming said pixel, wherein one scanning period of the plurality of scanning periods includes a reset period for bringing said liquid crystal having a memory effect at said pixel into a first stable state and a selection period for bringing said liquid crystal having a memory effect at said pixel into the first stable state or a second stable state, wherein during the reset period, said scanning electrode driving circuit brings the scanning voltage to a first voltage (VD) smaller in absolute value than threshold voltages at which the stable state of said liquid crystal having a memory effect changes, and said signal electrode driving circuit brings the signal voltage to a third voltage (VD +VS) being a sum of a second voltage (VS) larger in absolute value than the threshold voltages at which the stable state of said liquid crystal having a memory effect changes and the first voltage (VD), and wherein during the selection period, said scanning electrode driving circuit brings the scanning voltage to the second voltage (VS), and said signal electrode driving circuit brings the signal voltage to a voltage zero or the first voltage (VD).

21. The driving circuit for a liquid crystal panel with a memory effect according to claim 20, wherein said scanning electrode driving circuit and said signal electrode driving circuit output a voltage of the third voltage (VD+VS) during the first scanning period of the plurality of scanning periods.

22. The driving circuit for a liquid crystal panel with a memory effect according to claim 20, wherein the voltages outputted by said scanning electrode driving circuit and said signal electrode driving circuit are four values which are the voltage zero, the first voltage (VD), the second voltage (VS), and the third voltage (VD+VS).

23. The driving circuit for a liquid crystal panel with a memory effect according to claim 19, wherein a reference potential during the first scanning period of the voltage outputted by each of said scanning electrode driving circuit and said signal electrode driving circuit is different from a reference potential during the subsequent scanning period, and each of the reference potentials is the voltage zero or the first voltage (VD).

24. The driving circuit for a liquid crystal panel with a memory effect according to claim 22, wherein a reference potential during the first scanning period of the voltage outputted by each of said scanning electrode driving circuit and said signal electrode driving circuit is different from a reference potential during the subsequent scanning period, and each of the reference potentials is the voltage zero or the first voltage (VD).

25. The driving circuit for a liquid crystal panel with a memory effect according to claim 14, wherein said scanning electrode driving circuit and said signal electrode driving circuit have the same circuit configuration and are compatible with each other.

* * * * *